US006758547B2

(12) United States Patent
Ahne et al.

(10) Patent No.: US 6,758,547 B2
(45) Date of Patent: Jul. 6, 2004

(54) METHOD AND APPARATUS FOR MACHINE SPECIFIC OVERCURRENT DETECTION

(75) Inventors: Adam J. Ahne, Lexington, KY (US); Ricky E. Robbins, Harrodsburg, KY (US); Michael K. Webb, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 10/192,597

(22) Filed: Jul. 10, 2002

(65) Prior Publication Data

US 2004/0008233 A1 Jan. 15, 2004

(51) Int. Cl.[7] ..... B41J 29/393
(52) U.S. Cl. ..... 347/19; 347/14; 347/5
(58) Field of Search ..... 347/14, 19, 5; 324/433, 678

(56) References Cited

U.S. PATENT DOCUMENTS

| | | | | |
|---|---|---|---|---|
| 4,119,973 A | | 10/1978 | Stager | |
| 4,293,888 A | | 10/1981 | McCarty | |
| 4,553,867 A | | 11/1985 | Nakai | |
| 4,774,526 A | | 9/1988 | Ito | |
| 4,812,673 A | | 3/1989 | Burchett | |
| 5,359,291 A | | 10/1994 | Dommerich, III | |
| 5,432,665 A | | 7/1995 | Hopkins | |
| 5,518,326 A | | 5/1996 | Yoshino et al. | |
| 5,736,997 A | | 4/1998 | Bolash et al. | |
| 5,748,217 A | | 5/1998 | Bliss | |
| 5,798,648 A | * | 8/1998 | Ueyama et al. | 324/548 |
| 5,852,369 A | | 12/1998 | Katsuma | |
| 6,039,428 A | | 3/2000 | Juve | |
| 6,168,252 B1 | * | 1/2001 | Yaji | 347/14 |
| 6,183,056 B1 | | 2/2001 | Corrigan et al. | |
| 6,199,969 B1 | * | 3/2001 | Haflinger et al. | 347/19 |
| 6,204,671 B1 | | 3/2001 | Katsuma | |
| 6,437,575 B1 | * | 8/2002 | Lin et al. | 324/433 |
| 6,448,784 B1 | * | 9/2002 | Belau et al. | 324/548 |

* cited by examiner

*Primary Examiner*—Hai Pham
*Assistant Examiner*—Lam S Nguyen
(74) *Attorney, Agent, or Firm*—Thompson Hine, LLP

(57) ABSTRACT

The invention is drawn to a test circuit for an ink jet printer which measures the voltage decay over time. Specifically, the test circuit utilizes a known resistor connected to the power source (voltage) and the printer. The printer functions as a capacitor to complete the test circuit as an RC circuit. After isolating the power source from the test circuit, the voltage decay is monitored to indicate the presence of a short circuit.

14 Claims, 3 Drawing Sheets

METHOD AND APPARATUS FOR MACHINE SPECIFIC OVERCURRENT DETECTION

CROSS-REFERENCE TO RELATED APPLICATIONS

None.

STATEMENT REGARDING FEDERALLY SPONSORED RESEARCH OR DEVELOPMENT.

Not Applicable.

BACKGROUND OF THE INVENTION

1. Field of the Invention

The present invention relates to a thermal ink jet recording apparatus employed for recording information in the form of visual images and symbolic characters by means of electrically effecting the ejection of ink droplets onto an ink receiving/recording media (e.g. sheets of paper and the like). More particularly, the present invention relates to a method and apparatus for detection of potentially damaging overcurrent situations in an ink jet print head.

2. Related Art

Ink jet recording apparatus have several well known advantages. For example, the noise level generated by printing/recording is so low as to be negligible and ordinary sheets of paper may be employed without processing and/or coating special synthetic materials on the surfaces thereof. There exist various kinds of ink jet ejecting methods used in the ink jet recording apparatus and in recent years, some of these methods have been put into practical uses.

Among the various kinds of ink jet ejecting methods, one ink jet ejecting method that has proved not only viable, but reliable and relatively inexpensive is described in U.S. Pat. No. 5,319,389, issued on Jun. 7, 1994 to Ikeda et al. Described in that patent is an ink jet ejecting method which employs kinetic energy for ejecting ink droplets by transferring thermal energy into the ink. In this method, thermal energy from a liquid-to-vapor transition of the ink leads to a rapid volumetric change in the ink. An ink droplet is ejected from an ejection outlet formed at the front of a recording head. The ink-receiving or ink-recording medium is placed close to the nozzle, and the ejected droplet reaches the surface of the recording medium, thus establishing printing.

A print head used in the above described ink ejecting method, in general, has an ink ejection outlet for ejecting ink droplets, and an ink liquid passage which communicates with the ink ejection outlet. The ink liquid passage includes an electro-thermal converting element for generating the thermal energy. The electro-thermal converting element includes a resistance layer for heating by applying a voltage between two electrodes in the material. In this kind of a print head, forces are applied into the ink in the ink liquid passage, which are induced by capillary action, pressure drops or the like, and are balanced so that a meniscus is formed in the liquid passage adjacent the ink ejection outlet. Every time an ink droplet is ejected, by means of the balanced forces applied to the ink, ink is drawn into the ink passage and a meniscus is formed again in the ink passage adjacent the ink ejection outlet.

The other type of ink jet printer utilizes a piezo-electric crystal element instead of the thermal element. The crystal expands when energized causing the ink to be sprayed from the nozzle.

There are numerous difficulties that may occur with an ink jet system such as that heretofore described. For example, the active nozzle heater driver circuit, including the heater, for applying thermal energy to the ink, is often located on an integrated circuit chip (as opposed to discrete components). The active nozzle heater circuits (if field effect transistors are used) normally have their sources connected to ground on the chip. The ground is conventionally wired through the chip, and small bits of contamination may cause a low impedance short or an actual short. Many times in the manufacture of such integrated chips, a layer associated with the heater resistor may be inadvertently connected to ground or punched through for connection to another resistance layer. The increased current through the external line driver results in breakdown or failure of the driver after prolonged operation. Moreover, during connection to the pads of the chips to the external electronic circuitry of the machine, occasionally the TAB bonder machine errs and connects the ground beam to the data line pad on the heater on the chip, causing a data line to ground short circuit. (This kind of short also may occur with address lines.) The result of any of these type manufacturing errors, of course, may result in "blown" line drivers.

Conventionally the interconnection between the chip and the external world is through a TAB circuit or tape that connects the data line to the heater chip pads and another pad to ground. The tape or TAB circuitry is coated to inhibit ink that happens to spread under the TAB circuit, from shorting lines on the circuit. Occasionally this coating may be flawed and may include voids. Moreover, ink deposited in a manner to underlie (partially) a TAB circuit, tends to migrate or grow over time between the ground TAB circuit and the data TAB circuit. This occurs because the ink is ionic, and the positive and ground potential will tend to be attractive to the ink. Once a bridge-like contact occurs, a short condition exists and line driver destruction is likely to occur.

While such manufacturing caused defects and shorted conditions should be detected in the chip electrical test, the faults described may be intermittent or occur only after a period of operation (e.g. the ink migration condition mentioned above). Moreover, the chip electrical test acts as a bottleneck to increased production. Therefore, it is advantageous, as will be seen hereinafter, to allow for dynamic testing under usage conditions, which will permit testing in the machine in a manner to inhibit catastrophic breakdowns, especially with respect to driver circuits.

Failure to detect a short circuit in the print head can cause damage to the voltage regulator, the print head itself or in some cases damage the entire printer. The result of an undetected short can range from poor print quality to necessity of replacing the entire printer.

In the ink jet printer art, testing of ink jet printers to protect against short circuits due to ink contamination of high voltage electrostatic plates, is well known. For example, in U.S. Pat. No. 4,171,527 a circuit is disclosed which senses the fouling of an electrostatic ink jet head and causes shutoff of the head and of the associated electronics. Ink fouling is sensed by detecting contamination of the charge electrodes or of the deflection plates by conductive ink. The circuit employs a strobe in conjunction with a comparator which acts as a gate so that testing occurs only upon command.

U.S. Pat. No. 4,119,973, issued on Oct. 18, 1978 discloses a fault detection and compensation circuit for ink jet printer wherein the control circuitry monitors the potential of the deflection electrode and if an electrode short substantially persists for a period of time greater than a preselected period, the printer will be disabled and the printing operations will be terminated. See FIGS. 1–4, column 2 lines 10–45 and claims 1–4. Again, the patent deals specifically with highly conductive ink, and electrostatic ink jet printing.

U.S. Pat. No. 4,439,776, issued on Mar. 27, 1984, discloses ink jet charge electrode protection circuitry wherein the operational status of each charge electrode is determined by monitoring either the voltage level of the electrode or the current flowing to the electrode. If the voltage level is below a defined level or the current flow is above a defined level, a fault condition is detected and the charge electrode supply voltage of the ink jet printer is shut down to avoid damage, specifically to the charge electrodes.

U.S. Pat. No. 4,774,526 discloses a method of measuring the current flowing into the print head in order to detect a short. This method requires the printer to be in a stable state (i.e. nothing in operation) prior to measuring for a fault. Current is applied through the test circuit and measured after traveling through the print head in order to determine if a short exists causing a drop in the expected measured current.

U.S. Pat. No. 5,736,997 discloses a method of measuring the voltage to detect a lower than expected impedance. This patent also discloses a method of inhibiting activation of the region suspected of containing a short.

The advent of the Multi-Function Printer (MFP) or All-in-One (AIO) device has necessitated a change in the overcurrent protection scheme employed to protect these devices. Those systems utilizing a current measurement scheme require an idle state to be effective. This affects throughput as the scanner motor or scanner lamp must be idled or shut off prior to testing. Other systems utilizing a voltage measurement scheme also require the above idle state to be effective.

There is a need for an overcurrent detection scheme for the printer which can be employed at any time. Specifically, an overcurrent detection scheme is needed which can test for the presence of a short circuit between swaths of a print head that does not require the rest of the machine to be idled. A calibration process is needed to account for manufacturing tolerances in order to reduce the incidence of a false positive overcurrent detection. Finally, a re-calibration process is needed to account for the age related degradation of a system and to allow re-testing to confirm an overcurrent detection.

SUMMARY OF THE INVENTION

The instant invention meets all of these needs. The invention is drawn to a test circuit which measures the voltage decay over time. Specifically, the test circuit utilizes a known resistor connected to the power source (voltage) and the printer. The printer functions as a capacitor to complete the test circuit as an RC circuit. After isolating the power source from the test circuit, the voltage decay is monitored to indicate the presence of a short circuit. It is well known that the voltage of an RC circuit will decay to a third of the initial voltage over a period of time called the Time Constant (TC). In use, the test circuit measures the voltage prior turning the voltage off, and then at a time equal to the TC. If the subsequently measured voltage is less than one third of the initially measured voltage then a short circuit may exist.

Initially contemplated for the invention was a test circuit in which the TC was computed from specified system components. Due to the wide range of manufacturing tolerances for the system components, it became likely that a short circuit would be detected that did not exist (false positive) or a short circuit would not be detected that actually exists (true negative). Accordingly, a calibration method was developed using the test circuit of the invention to determine the actual TC of the system. As a result, the overcurrent detection scheme becomes specific to the machine on which it is implemented. Because the invention accounts for manufacturing tolerances, manufacturing costs can be lowered by allowing use of cheaper components (having a greater range of acceptable capacitance).

Finally, it was discovered that age related degradation of the printer capacitance could cause the false detection of a short circuit on an older machine. The invention allows the test circuit to be re-calibrated to account for this age related change. Thus, if a short circuit is detected, the operator has the option of recalibrating the system and re-testing to confirm the fault. As a result, the useful life of the printer can be extended.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
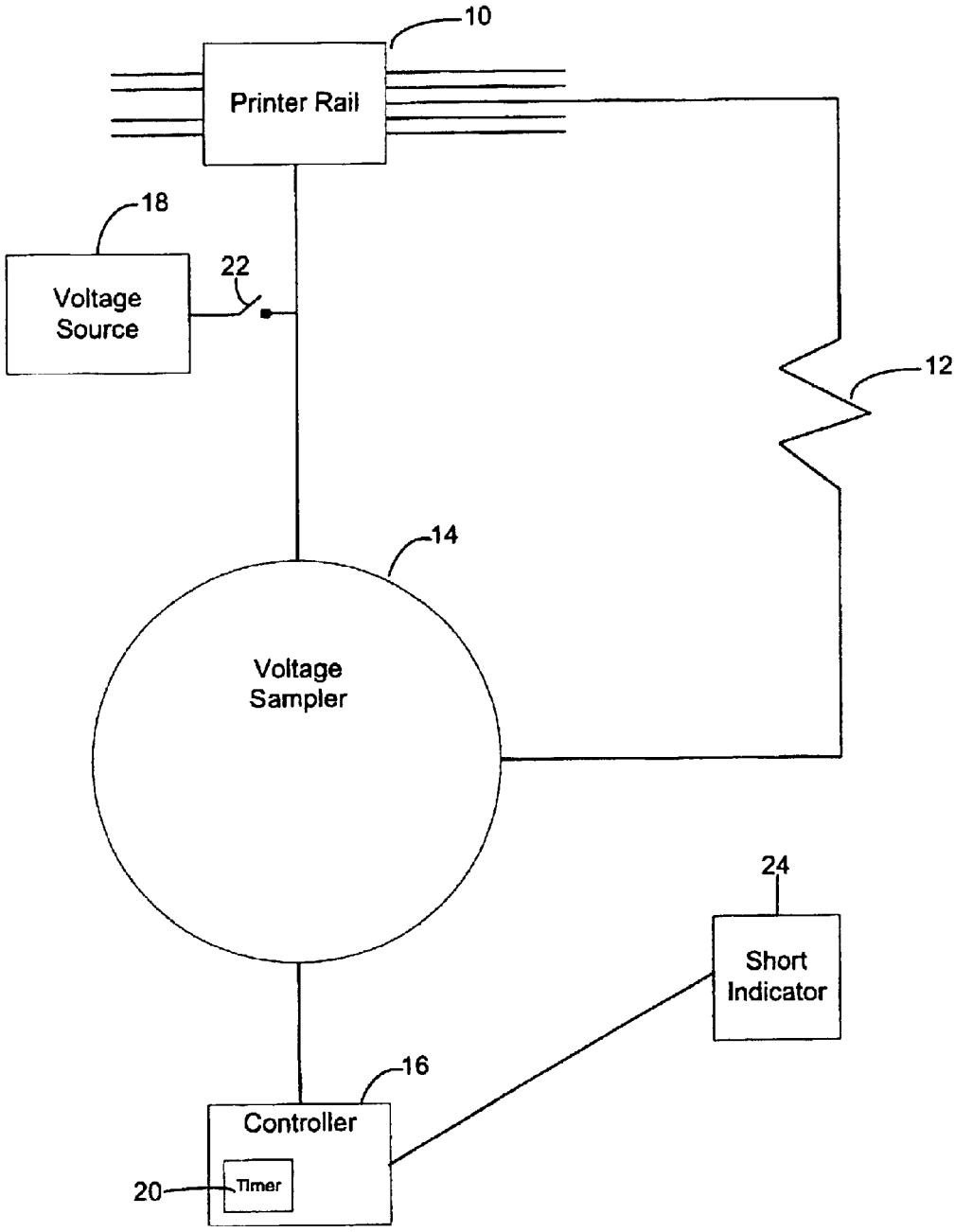
FIG. 1 illustrates the test circuit.

The invention utilizes a physical law governing the behavior of an electrical circuit having a power source, a resistor, and a capacitor. It is well known that a circuit will attain a state of equilibrium having a constant voltage when a voltage is applied to the circuit by the power source. When the power source is removed, the resulting circuit having a resistor and a capacitor (RC circuit) will behave in a predictable manner. The RC circuit having an initial voltage (Vi) decays according to the following formula:

$$V(t)=Vi*e^{-(t/RC)}$$

Where V(t) is voltage at a time "t," R is the resistance of the resistor, and C is the capacitance of the capacitor.

When a circuit is shorted, its voltage will decay more quickly than the formula indicates because the short circuit will divert current out of the circuit. A circuit voltage measured at a known time after the source voltage is removed will be lower than the formula predicts, when the circuit has a short. The present invention incorporates such a test circuit into the print head of an inkjet printer.

Those of skill in the art will recognize that the actual voltage can be tested against the predicted voltage at any time. In one embodiment, the comparison is made after an elapsed time equal to the time constant.

The time constant ("Tau") is the product of R and C. It can be seen that the voltage at a time equal to the Time Constant will be equal to V(i)*0.333 (i.e. $e^{-1}$=0.333). In other words, at a time equal to the time constant the initial voltage should decay by two thirds. In one embodiment, a measured voltage is compared to an expected voltage V(t), after the passage of time (t)=R*C. The existence of a short circuit is indicated when V(t)<0.333V(i).

In a preferred embodiment, the circuit test is accelerated by testing at ½Tau. Accordingly, the preferred test formula is V(t)=V(i)*e−(2t/T), where (t) is time equal to ½R*C. A short circuit is indicated when V(t)<V(i)*e−(2t/T). In another embodiment, the circuit may be tested by sampling the voltage as the capacitor charges. The expected voltage at V(t) should be V(t)=V(source)(1−e−(t/RC)). A short will extend the time necessary to fully charge the capacitor. Accordingly, a short would be indicated when V(t)<V (source)(1e−(t/RC)).

An ink jet print head utilizes a plurality of nozzles to selectively deliver ink. The print head attaches to the printer rail and is moved across the ink receiving medium. The printer rail provides an available supply of current to be sent to the print head. The capacitor is incorporated into the print rail. A separate capacitor could be used. Control circuitry is built into the printer to control all the mechanical aspects of operation, as well as decode the information sent to the printer. The printer rail functions as a capacitor in this system. Once the paper is fed into the printer and positioned at the start of the page, the print head stepper motor uses a belt to move the print head assembly across the page. The motor pauses for a fraction of a second each time that the print head sprays dots of ink on the page and then moves a tiny bit before stopping again. Multiple dots are made at each stop. It sprays the CMYK colors in precise amounts to make any color desired. At the end of each complete pass, the paper feed stepper motor advances the paper a fraction of an inch. Depending on the inkjet model, the print head is reset to the beginning side of the page, or, in most cases, simply reverses direction and begins to move back across the page as it prints. This process continues until the page is printed.

The overcurrent detection method is designed to be able to test the printer anytime the printhead rail is turned on and the printhead is not in active use. The present invention has an advantage over the prior art in that it is not dependent on other components. This allows it to be used either between swaths of the printhead, on cartridge installation or before maintenance. The most common usage will be between printhead swaths.

The test circuit of the overcurrent detection apparatus is shown in FIG. 1. This circuit is incorporated into a portion of the control circuitry in the preferred embodiment. The overcurrent detector could also be configured as a discrete unit. The printer rail (including the incorporated capacitor) 10, a test resistor 12, and a voltage sampler 14 are connected to form the test circuit. A controller 16 and a voltage source 18 are connected to the test circuit. The controller includes a timer 20. The voltage sampler 14 is an analog/digital converter in the preferred embodiment. Any other known sampling hardware may also be used as the voltage sampler 18. The voltage sampler 14 could also be embodied in software as a part of the controller 16.

The controller 16 is configured to receive an initial voltage V1 and a subsequent voltage V2 from the voltage sampler 14 and to store V1 and V2 in a memory. The controller also stores an elapsed time t between the measurement of the initial voltage V1 and the subsequent voltage V2. The controller calculates an expected voltage Vexp using V1, t and the following formula as discussed above:

$$Vexp=V1*e^{-(t/RC)}$$

The expected voltage Vexp involves a mathematical manipulation of the stored values V1 and t. Prior to the first use the value of RC must be set. It was originally contemplated to calculate the value of RC using the specifications of the components of the printer. It was found that the manufacturing variances in the acceptable capacitance made this an impractical solution. As a result the following calibration process was developed and incorporated into the invention.

Calibration

The calibration process uses the test circuit described above. After assembly, the print head is removed. A voltage is applied to the printer. The controller then opens a switch 22 to isolate the power source from the test circuit. The voltage is measured and stored. The voltage is continuously monitored and the time for the voltage to decay by two thirds is measured and recorded. In the preferred embodiment, this procedure is repeated several times and the measured times are averaged. The time constant TC is then set equal to the averaged time in the controller.

Use

After calibration the overcurrent detection method is to be used between swaths of the print head. While the printer is functioning a printer power supply provides a voltage to the printer rail. After the print head completes a swath of printing, the controller initiates a test sequence.

Figure 2:
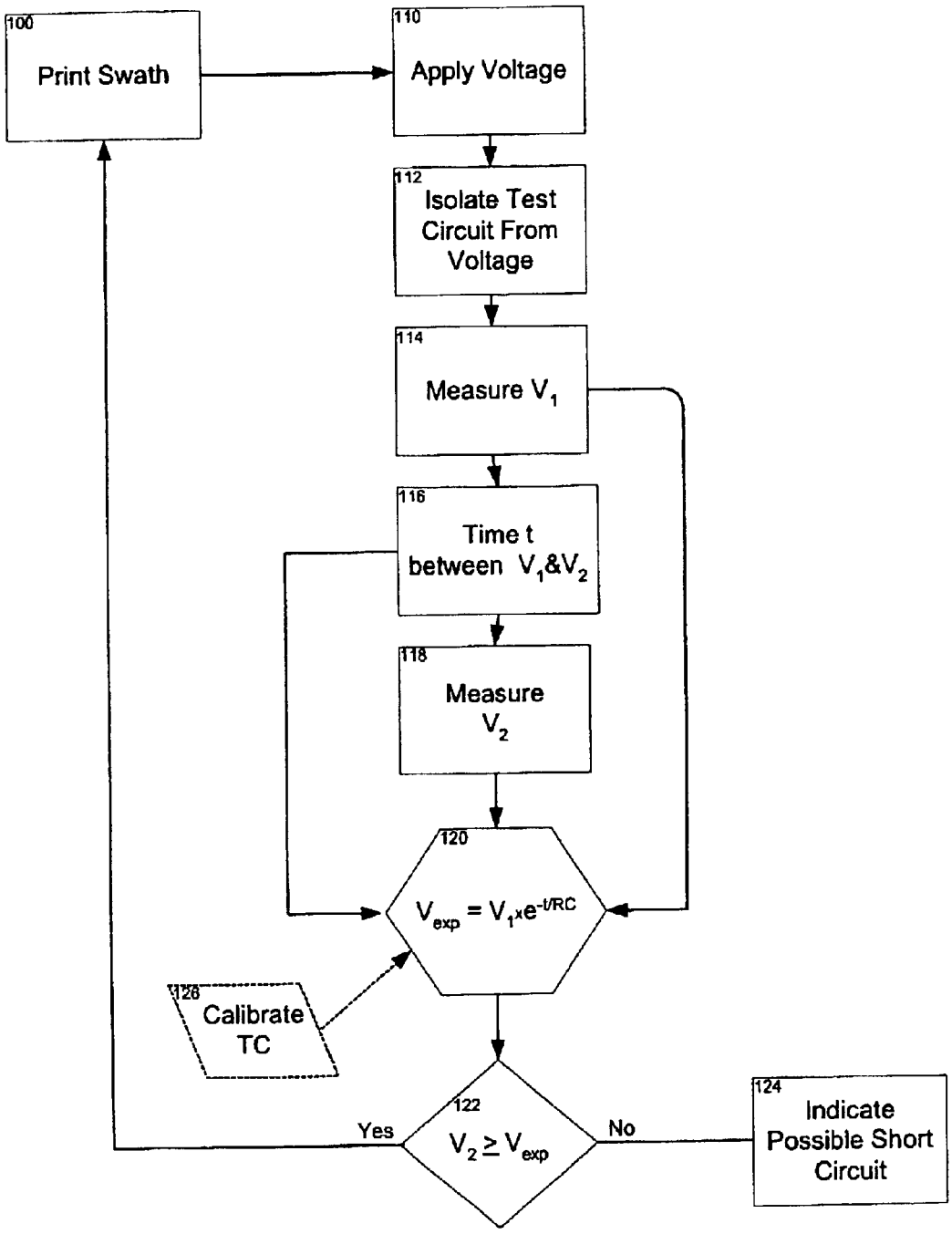
FIG. 2 illustrates a flow chart of the invention.

With reference to FIG. 2, the test sequence begins by isolating the test circuit 112 from the applied voltage 110. Then the sequence detects a first voltage 114, at a first time on said printer using the voltage sampler. The detected first voltage is stored by the controller for future reference. At a second time the voltage sampler detects a second voltage $V_2$ 118 in the test circuit of the printer. The controller then determines an elapsed time 116 between the first time and the second time. The elapsed time and the detected second voltage are stored by the controller 16 for future reference.

An expected voltage is calculated 120 using the formula below and the stored first voltage, the elapsed time and the stored time constant TC 126 that had been calculated during the calibration process. The following formula is used:

$$V(t)=Vi*e^{-(tRC)}$$

Using this formula it can be seen that the expected voltage $V_{exp}$ at a time "t" equal to the elapsed time should be the voltage remaining after the test circuit has decayed from the first voltage $V_1$ for a period of time equal to "t". This expected voltage is stored by the controller 16 for future reference. The expected voltage $V_{exp}$ is then compared to the second voltage $V_2$ at step 122. If the second voltage $V_2$ is less than the expected voltage $V_{exp}$ then the possibility of a short circuit exists. The controller then indicates a potential short circuit 124. If the second voltage $V_2$ is greater than or equal to $V_{exp}$ at step 122, the next print swath 100 is initiated.

In the preferred embodiment the detection scheme is used in a simplified manner to reduce the amount of computation the controller must perform. The controller samples the voltage at a beginning and an end of a predetermined time period. If this predetermined time period is equal to the time constant then the expected voltage will then be equal to one third of the voltage sampled at the beginning of the predetermined time period. This eliminates the need to calculate the expected voltage using the above noted equation. As a result, the delay between swaths of printing caused by testing the printer is minimized.

The potential short circuit is indicated to the user using an indicator 24 (FIG. 1). In the preferred embodiment the indicator 24 is a warning light which is illuminated by the controller when a potential short circuit is detected.

Re-Calibration

Figure 3:
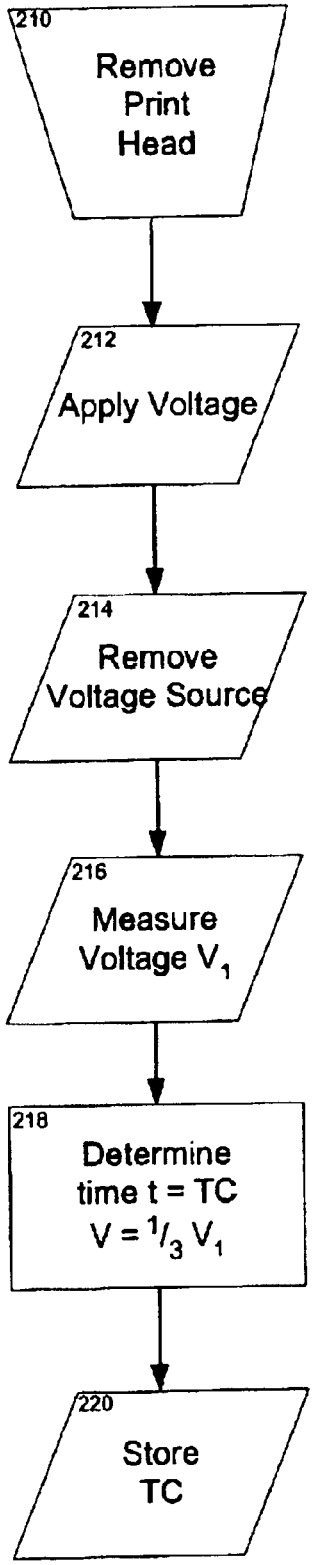
FIG. 3 illustrates a flow chart of the calibration process.

The scheme allows a user to confirm the existence of a detected short circuit. This involves re-calibrating and then retesting the printer. The re-calibration involves multiple steps as seen in FIG. 3. The print head is removed 210, and a voltage is applied 212. The controller then causes the voltage source to be isolated from the test circuit 214. A calibration voltage is measured by the voltage sampler 216 and stored by the controller. The voltage sampler then continuously monitors the voltage decay to a third of the original measured calibration voltage. The time constant TC is set, 218, to a value equal to the time it takes the calibration voltage to decay to one third of the original measured voltage. The time constant TC is stored, 220. After re-calibration, the print head is replaced and the printer is retested. If the short circuit is again detected, the controller will activate the indicator.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. For example, the voltage sampler could be a voltmeter or the predetermined time period could be set to one half of the time constant.

Thus, the breadth and scope of the present invention should not be limited by any of the above-described exemplary embodiments, but should be defined only in accordance with the following claims appended hereto and their equivalents.

What is claimed is:

1. A method for detecting a short circuit in an inkjet printer caused by a defective printhead, the method comprising the steps of:

applying a first voltage at a first time to a printhead rail including an associated capacitance and a printhead installed thereon;

disconnecting the first voltage from the printhead rail to permit voltage induced across said capacitance to decay;

detecting a second voltage at a second time across said capacitance;

determining an elapsed time between said first time and said second time;

calculating an expected voltage based on the first voltage, the elapsed time and a time constant previously determined during a calibration step performed without the printhead installed on the printhead rail;

comparing the second voltage to said expected voltage; and indicating a potential short circuit detection when said second voltage is less than said expected voltage.

2. The method of claim 1 further comprising the step of confirming the potential short circuit.

3. A method for detecting a short circuit in an inkjet printer caused by a defective printhead, the method comprising the steps of:

(i) performing a first voltage decay test in connection with a printhead rail of said printer without a printhead connected thereto and recording a test result parameter;

(ii) performing a second voltage decay test in connection with the printhead rail of said printer while a printhead is connected to the printhead rail and the printhead is inactive;

(iii) comparing a result of the second voltage decay test with an expected result that is a function of the recorded test result parameter; and (iv) identifying a potential short circuit based upon the comparing step.

4. The method of claim 3, wherein said first voltage decay test involves:

applying a calibration voltage to said printhead rail, said calibration voltage having an initial calibration voltage; and determining a time constant by measuring the time for said initial calibration voltage to drop by two thirds;

wherein the test result parameter comprises the time constant.

5. The method of claim 3 wherein if a potential short circuit is identified a further step of confirming the potential short circuit is performed.

6. The method of claim 5, wherein said confirming step comprises repeating steps (i), (ii), (iii) and (iv).

7. A method for detecting a short circuit in an inkjet printer caused by a defective printhead, the method comprising the steps of:

(i) performing a voltage decay test in connection with a printhead rail of said printer while a printhead is connected to the printhead rail and the printhead is inactive;

(ii) comparing an actual result of the voltage decay test with an expected result, where the expected result is set according to a calibration test result previously obtained during a calibration voltage decay test performed in connection with the printhead rail without the printhead connected thereto; and (iii) identifying a potential short circuit based upon the comparing step.

8. The method of claim 7 wherein at least step (i) is performed between printing swaths of the printhead.

9. The method of claim 8 wherein step (ii) is likewise performed between printing swaths of the printhead.

10. The method of claim 7 wherein the calibration test result comprises a stored time constant, the actual result is a detected voltage level and the expected result is a voltage level calculated in accordance with the stored time constant.

11. The method of claim 7 wherein if a potential short circuit is identified, a further step of confirming the potential short circuit is performed.

12. The method of claim 11 wherein the step of confirming the potential short circuit involves removing the printhead from the printhead rail and performing a new calibration voltage decay test.

13. A method for detecting a short circuit in an inkjet printer caused by a defective printhead, the method comprising the steps of:

(i) performing a voltage decay test in connection with a printhead receiving structure of said printer while a printhead is connected to the printhead receiving structure and the printhead is inactive;

(ii) comparing an actual result of the voltage decay test with an expected result, where the expected result is set according to a calibration test result previously obtained during a calibration voltage decay test performed in connection with the printhead receiving structure without the printhead connected thereto; and (iii) identifying a potential short circuit based upon the comparing step.

14. The method of claim 13 wherein the calibration test result comprises a stored time constant, the actual result is a detected voltage level and the expected result is a voltage level calculated in accordance with the stored time constant.

* * * * *